United States Patent [19]

Schneider et al.

[11] 4,353,792

[45] Oct. 12, 1982

[54] PROCESS TO UPGRADE COAL LIQUIDS BY EXTRACTION PRIOR TO HYDRODENITROGENATION

[75] Inventors: Abraham Schneider, Overbrook Hills, Pa.; Elmer J. Hollstein, Wilmington, Del.; Edward J. Janoski, Havertown; Edward G. Scheibel, Media, both of Pa.

[73] Assignee: Suntech, Inc., Philadelphia, Pa.

[21] Appl. No.: 117,596

[22] Filed: Feb. 1, 1980

[51] Int. Cl.[3] ..... C10G 17/00; C10G 45/00; B07B 1/34

[52] U.S. Cl. ..... 208/254 H; 208/330; 208/317

[58] Field of Search ..... 208/254 R, 254 H, 263, 208/330, 8 LE

[56] References Cited

U.S. PATENT DOCUMENTS

| | | | |
|---|---|---|---|
| 1,728,156 | 9/1929 | Wheeler | 208/263 |
| 1,859,015 | 5/1932 | Albright | 208/254 R |
| 1,971,786 | 8/1934 | Jones | 208/263 |
| 2,112,313 | 3/1938 | Somers | 208/263 |
| 2,210,542 | 8/1940 | Byrns | 208/263 |
| 2,518,353 | 8/1950 | McKinnis | 208/254 R |
| 2,741,578 | 4/1956 | McKinnis | 208/254 R |
| 2,754,248 | 7/1956 | Wetzel | 208/254 R |
| 2,769,767 | 11/1956 | Fierce | 208/263 |
| 2,905,380 | 2/1960 | Fleck | 208/254 R |
| 2,925,379 | 2/1960 | Fleck | 208/254 R |
| 2,943,049 | 6/1960 | Nahin | 208/254 R |
| 2,944,014 | 7/1960 | Hoffman | 208/263 |
| 2,956,946 | 10/1960 | King | 208/263 |
| 2,975,381 | 2/1960 | Fleck | 208/254 R |
| 3,153,626 | 10/1964 | Kulik | 208/22 |
| 3,260,666 | 7/1966 | Flinn | 208/254 R |
| 3,317,419 | 5/1967 | Fortman | 208/254 H |
| 3,367,861 | 2/1968 | Aldridge | 208/254 H |
| 3,717,571 | 8/1973 | Schulman | 208/254 H |
| 4,113,607 | 9/1978 | Miller | 208/254 R |
| 4,125,452 | 11/1978 | Effron | 208/263 |
| 4,159,940 | 7/1979 | Smith | 208/254 H |
| 4,272,362 | 6/1981 | Schneider et al. | 208/330 |

OTHER PUBLICATIONS

Gates et al., *Chemistry of Catalytic Reactions*, McGraw-Hill (1979) pp. 390-393.

Bronstein et al. in *Khimeiia Tverdogo Topliva* (Moscow) vol. 3 (1979), pp. 60-67.

*Hydrocarbon Processing*, May 1979, pp. 152-154 (de Rosseto).

Kirk-Othmer, *Encyclopedia of Chemical Technology* Supplement pp. 177-197, vol. 19, pp. 653-682.

Chemical Abstracts vol. 77 (1972), No. 100675g, vol. 91, (1979) No. 195,693n, vol. 85, (1976), No. 80,620v.

*Primary Examiner*—Brian E. Hearn

*Attorney, Agent, or Firm*—J. Edward Hess; Donald R. Johnson; Patrick C. Baker

[57] ABSTRACT

Oxygen compounds are removed, e.g., by extraction, from a coal liquid prior to its hydrogenation. As a result, compared to hydrogenation of such a non-treated coal liquid, the rate of nitrogen removal is increased.

6 Claims, No Drawings

PROCESS TO UPGRADE COAL LIQUIDS BY EXTRACTION PRIOR TO HYDRODENITROGENATION

BACKGROUND

This invention was made during the course of U.S. Government Contract EF-76-C-01-2306 with the U.S. Department of Energy.

Field of the Invention

This invention relates to an improvement in the hydrogen treating of a coal liquid, i.e., a liquid derived from coal via various conversion processes, including hydroliquefaction. More specifically, the invention involves the removal of oxygen compounds from a coal liquid prior to its treatment with hydrogen. Removal of the oxygen compounds results in a substantial increase in the rate of removal of undesirable nitrogen compounds by the hydrogen and for a given amount of hydrogen the H/C ratio of the treated liquid is increased compared to a non-treated liquid.

Description of Prior Art

It is known that a crude coal liquid contains nitrogen compounds. And generally it is known that it is desirable to remove such nitrogen compounds from the liquid prior to its conversion to such products as gasoline and heating oil. Further, it is known that nitrogen compounds, when present in the liquid, deleteriously affect the acidic catalyst used in subsequent hydroprocessing of the liquid. Usually, the nitrogenous material therein causes undesirable deactivation of the catalyst. Consequently, a variety of treatments are taught in the art for reducing the organic nitrogenous component of the liquid. For example, U.S. Pat. No. 3,717,571 suggests using two hydrogenation stages to hydrotreat and denitrogenate a coal liquid having a high nitrogen content. Use of a solid contacting material, e.g., metallo alumino silicate, which exhibits specific adsorption properties for nitrogen compounds contained in coal tar oils, is disclosed in U.S. Pat. Nos. 2,925,379; 2,925,380; 2,925,381 and 2,943,049. Use of $SO_2$ and water to extract nitrogen compounds from coal tar oil is disclosed in U.S. Pat. No. 2,754,248. Use of certain acids to remove nitrogen compounds from coal liquids is suggested in U.S. Pat. No. 4,159,940. U.S. Pat. No. 2,518,353 suggests the use of acid ammonium or amino, or salts of strong non-volatile acids in an aqueous solution to extract nitrogen compounds from coal tar fractions. U.S. Pat. No. 2,741,578 suggests the use of selective solvents, e.g., organic hydroxy compounds such as ethylene glycol. Another kind of treatment involves extraction of nitrogen compounds from a hydrogenated oil using an extracting medium a solution of ferric chloride in furfural, see U.S. Pat. No. 4,113,607.

In general crude liquids from coal contain oxygen sulfur and nitrogen compounds, e.g., see Kirk-Othmer, Encyclopedia of Chemical Technology, 2nd Edition, Supplement Volume, pages 177–197, also Hydrocarbon Processing, May 1979, "Upgrade Coal Derived Distillates," A. J. deRosset et al, page 152–154. Removal of phenols and tar acids from a coal tar, the latter resulting from the heating of bituminous coal in an oven, sealed from the air, to form coke, by use of basic materials is disclosed in e.g., U.S. Pat. Nos. 1,971,786 and 1,859,015 and Kirk-Othmer, Encyclopedia of Chemical Technology, 2nd Vol. 19, Tar and Pitch, pages 653–682. Generally a coal tar is treated for the purpose of separating out particular chemicals for chemical end uses. However, none of the foregoing references disclose or suggest removing oxygen compounds from coal liquids as a means of improving subsequent hydrodenitrogenation.

Also, performs liquids generally are known to contain oxygen compounds, e.g., phenols and naphthenic acid, e.g., see U.S. Pat. No. 1,728,156. Removal of such oxygen compounds by use of basic materials are disclosed in e.g., U.S. Pat. Nos. 2,112,313 and 2,210,542. Extraction of organic acids from petroleum distillates is known, e.g., see U.S. Pat. No. 2,769,767 which discloses treating the distillate with a mixture of an aliphatic organic amine, a low boiling alcohol and water. Other techniques for removing acids from petroleum distillates are disclosed e.g., see U.S. Pat. No. 2,956,946. U.S. Pat. No. 2,944,014 discloses treating an acidic petroleum crude with an alkali in an atmosphere distillation unit; taking the resulting soap-oil mixture and separating out the oil which is then fed to a vacuum distillation unit along with other heavier fractions which have been obtained by vacuum distillation of the fraction, taking one of the streams from the vacuum units and feeding it to a hydrogenation unit. The purpose of the foregoing treatment is to recover naphthenic acids and to obtain high boiling neutral lubricating oil distillates. However none of the foregoing references disclose or suggest removing oxygen compounds from coal liquids as a means of improving subsequent hydrodenitrogenation.

Also U.S. Pat. No. 3,260,666 discloses treating a petroleum fraction, e.g., a fluid catalytically cracked furnace oil, with an aqueous potassium hydroxide to remove some nitrogen compounds, thereby allowing a subsequent hydrogenation to be more effective. It also suggests that the aqueous potassium hydroxide treatment is applicable to products produced by pyrolysis of carbonaceous materials such as creosote oil. However, applicants' treatment of a solvent refined coal liquid with potassium hydroxide failed to remove nitrogen compounds, see Examples.

Present invention first reduces the amount of oxygen compounds contained in a coal liquid, including a crude coal liquid and a whole coal liquid, and then hydrotreats the treated coal liquid to reduce the level of nitrogen contained in the coal liquid.

SUMMARY OF THE INVENTION

The present invention provides an improvement in the processing of a coal liquid, in that prior to hydrotreating the coal liquid, oxygen compounds contained therein are removed. Removal or reduction in the amount of the oxygen compounds surprisingly facilitates the next processing step, the hydrotreating of the treated coal liquid. Several advantages are obtained by the oxygen removal. First is that the rate of the removal of nitrogen is substantially increased, which means that the size of the equipment used for a given throughput can be smaller, and smaller sized equipment means less capital investment. Alternatively, it also means that more throughput is possible through a given-sized unit. Another advantage is that less hydrogen is necessary to obtain a desired H/C level. Alternatively, it also means that for a given amount of hydrogen, more liquid can be treated to a desired H/C level. More effective use of hydrogen on either basis results in lower operating costs. Another advantage is that the amount of undesirable gases and low boiling liquids produced is reduced, thereby increasing the volume of liquid products. Increased volume of liquid products increases the total value of the products produced.

The removal or reduction in the amount and kind of the oxygen compounds can be achieved by chemical or physical means. For example, the removal or reduction in the amount of oxygen compounds can be accomplished by treatment of a coal liquid, with an aqueous or organic solution of a base. The use of a base is indicated because the oxygen compounds in the liquids are predominantly phenolic. Other examples would be liquid extraction using a suitable solvent, e.g., aqueous methanol or extraction with a basic organic substance, e.g., ethanolamine. An effective extraction solvent is a mixture of a dialkylformamide, e.g., N,N'-dimethylformamide, and a paraffinic hydrocarbon, e.g., heptanes. Still another example would be the treatment of the coal liquid with a solid basic substance such as lime or an absorbent such as a basic alumina. The foregoing methods will also remove some of the other compounds, such as nitrogen compounds, however, an object is to remove oxygen compounds, particularly those which can have an adverse effect on subsequent removal of nitrogen.

DESCRIPTION

This invention is a process improvement in the contacting of a coal liquid with hydrogen and a hydrogenation catalyst at effective hydrogenation conditions. The improvement involves, prior to the contacting, the removal of enough oxygen compounds contained in the coal liquid such that the removal rate of the nitrogen compounds during the hydrogenation of the coal liquid is greater than that which would occur during hydrogenation of a coal liquid from which the oxygen compounds were not removed. Measurement and calculation of the rate is described under Examples. In one preferred embodiment the amount of oxygen compounds removed is sufficient to increase substantially the rate of hydrogenation of the coal liquid from which the oxygen compounds were removed. In a more preferred embodiment the hydrogenation process is a hydrodenitrogenation in that a hydrodenitrogenation catalyst and effective denitrogenation operating conditions are employed. In the previous embodiments a still more preferred process employs the removal of the oxygen compounds by contacting the coal liquid with a base at suitable conditions and then separating the base-oxygen compounds from the remaining coal liquid which is subsequently treated with hydrogen. Another embodiment involves the removal of the oxygen compounds by contacting the coal liquid with an extraction solvent which is highly selective for oxygen compounds in the coal liquid at suitable extraction conditions and then separating the solvent-extract and raffinate. Further involved can be the separation of the solvent from the solvent-extract and the subsequent processing of the extract. The raffinate is subsequently treated with hydrogen under suitable conditions and with a suitable catalyst whereby the nitrogen compounds are removed at a rate which is greater than that which occurs if the nitrogen compounds were not removed from the coal liquids.

"Hydrodenitrogenation" as used herein refers to hydrogen treatment to convert nitrogen compounds contained in a coal liquid whereas "hydrogenation" refers to reactions with hydrogen generally. The nitrogen compounds generally are converted to hydrocarbons and ammonia by contacting the coal liquid with hydrogen in the presence of a suitable catalyst at suitable operating conditions as to temperature and pressure. Often the foregoing is referred to as the removal of nitrogen compounds. Many different kinds of suitable catalysts are available and often they are referred to as hydrogenation of hydrodenitrogenation catalysts. Examples of such catalysts are as follows: nickel-molybdenum on alumina, cobalt-molybdenum on alumina and nickel-tungsten on alumina. Catalysts which are inexpensive and still effective are preferred and examples of these are the nickel-molybdenum and cobalt-molybdenum. The temperature for the hydrogenation treatment can be in the range of between from about 300° C. to about 450° with about 350° C. to about 425° C. preferred. The pressure, i.e., the partial pressure of the hydrogen, can be in the range of between from about 200 psig to about 5000 psig with about 1000 psig to about 4000 psig preferred. Generally the nitrogen level ($N_T$) of the resulting product can be at a level which permits the feed to be used without further treatment in a hydrocracker or a catalytic cracking unit. It should be noted that while the hydrodenitrogenation is occurring other hydrogenation reactions, such as desulfurization can also be occurring.

"Coal" as used herein refers to brown coal, lignite, subbituminous coal, bituminous coal and anthracite. "Coal liquid" as used herein refers to the whole crude coal liquid or a fraction thereof, obtained from coal by various processes such as hydroliquefaction. Particular known processes include Solvent Refined Coal-I; Solvent Refined Coal-II; Exxon Hydrogen Donor Process and Hydrocarbon Research Inc. Process; and the COED (Char-Oil-Energy Development) process which is a multistage fluidized bed pyrolysis of volatile coals. Except for the last named process, such processes involve contacting coal particles with a hydrocarbon solvent (optional) at an elevated temperature and pressure and in the presence of hydrogen and often in the presence of a catalyst. Separation of catalyst and coal ash follows the contacting after which the whole crude coal liquid can be processed further. "Crude" indicates that the liquid is from a coal conversion process and is without further processing while "whole" indicates no separation into fractions.

In this invention the whole crude coal liquid can be treated or the liquid can be separated into different boiling point fractions and each or certain fractions can be treated so as to remove the oxygen compounds. The distribution of oxygen and nitrogen compounds throughout the whole crude coal liquid is not equal. Thus, for example, a light naphtha fraction, e.g., one boiling up to about 250–325° F., probably could be fractionated from the whole crude coal liquid since it does not contain adverse amounts of oxygen and/or nitrogen compounds. Consequently, the preferred feed for the present invention is one with a boiling range from between about 250° F. to about 1050° F. with a more preferred boiling range from between about 325° F. to about 850° F.

Thus, in this invention the feed can be the whole crude coal liquid or a suitable fraction which requires further processing to reduce its nitrogen content. The feed is first treated by chemical or physical means to remove oxygen compounds contained therein. The amount of removal can be substantial, e.g., about 80–90 wt.%, yet the removal need not be absolutely complete. The amount and kind that should be removed can be determined by an economic balance of the cost of removal versus the value of benefit, particularly to the point where the incremental cost of removal equals the incremental value of benefit. One element of the benefit is the increased rate of nitrogen removal with its accompanying increased efficient use of hydrogen. Thus generally the effect of the oxygen compound removal is that the increase in the rate and extent of nitrogen removal of the treated coal liquid is substantial.

The removal of the undesirable oxygen compounds from a coal liquid including a whole crude coal liquid or its fractions can be accomplished by various chemical or physical means. For example, chemical means would involve contacting the coal liquid with an aqueous or organic solution of a base such as sodium hydroxide or potassium hydroxide, or a solid base substance, e.g., lime or a basic absorbent, e.g., basic alumina, or a combination of such means. Physical means would be exemplified by liquid extraction using a suitable solvent, e.g., aqueous methanol. The removal of oxygen compounds could also be accomplished even by a combination of chemical and physical means.

The removed oxygen compounds can be separated from whatever means are used to remove them from the coal liquid and then used. Included in the latter uses are hydrotreating the oxygen compounds at conditions optimum for oxygen compounds to produce more hydrocarbons or using the removed oxygen compounds for chemical purposes. Also the oxygen compounds could be burned as fuel or reacted to produce hydrogen which then could be used in a hydrodenitrogenation step or other hydrogen consuming processing steps.

Following are examples which illustrate embodiments of the invention and comparative examples, which highlight the advantage of applicants' method.

EXAMPLES

The first run shown is a comparative run; the elemental analysis of the coal liquid used as feed is shown in Table 1, Column (1). Present petroleum technology generally can not economically process the coal liquid shown in Table 1 because its nitrogen level is too high. Current maximum economical processable amount is about 0.3 wt.% nitrogen but more typically processed petroleum liquids contain about 0.1–0.15 wt.% nitrogen. The amount of oxygen and sulfur present in the coal liquid, while consuming hydrogen in subsequent processing steps, is also believed to be economically processable, with some difficulty, with present petroleum technology.

The coal liquid used was a solvent refined coal liquid (also referred to as SRC-II) middle distillate (MD) having a boiling range of about 300–600° F. About 292 grams of the coal liquid were contacted with hydrogen in the presence of a Ni-Mo catalyst, which had been treated with $H_2S$, at the conditions reported in Table I, Column (2). The total nitrogen ($N_T$) of the feed was reduced from 1.16 wt.% to 0.28 wt.%, while the H/C ratio increased from 1.27 to 1.47. Other elemental data of the final product are reported in Table I, Column (2). Samples of the reaction mixture were taken during the runs and analyzed but only product results are reported herein.

TABLE I

Method of Invention Shows Substantial Decrease In Nitrogen Content After Hydrogen Treatment

| | COMPARATIVE RUN | | METHOD OF INVENTION | |
|---|---|---|---|---|
| | (1) Feed | (2) Hydrogen Treat of Feed | (3) Feed (1) after Removal of O | (4) Hydrogen Treatment of Feed (3) |
| Reaction Conditions | | | | |
| Time, min. | — | 120 | — | 120 |
| Temp. °C. | — | 400 | — | 400 |
| Press.,psig | — | 2500 | — | 2500 |
| Feed SRC-II, MD,gms. | — | 292.4 | — | 287.8 |
| Catalyst[a] Wt. gms. | — | 14.6 | — | 14.4 |
| Hydrogen Consumed Wt. gms. | — | 6.38 | — | 5.11 |
| Wt., % | — | 2.18 | — | 1.78 |
| Product Analysis Element, wt. % | | | | |
| C | 86.39 | 87.15 | 85.31 | 88.21 |
| H | 9.16 | 10.67 | 9.20 | 11.13 |
| O | 3.58 | 0.86 | 0.61 | 0.18 |
| $N_T$* | 1.16 | 0.28 | 1.39 | 0.04 |
| $N_B$ | 0.87 | — | 0.98 | — |
| S | 0.14 | — | — | 0.03 |
| H/C Atomic Ratio | 1.27 | 1.47 | 1.28 | 1.51 |

[a]Ni—Mo catalyst containing about 3.7 wt. % of NiO and about 17 wt. % of $MoO_3$ on alumina and about 0.25 wt. % CoO.
*Via Kjeldahl analysis The next run involved the removal of some oxygen compounds from the feed having the elemental analysis shown in Table I, Column (1). The feed having the analysis as shown in Column (1) was treated with 15 wt.% aqueous KOH solution and the oxygen content was reduced from 3.58 wt.% to 0.61 wt.% whereas the total nitrogen content was increased in the KOH raffinate as shown by a comparison with Column (3). The KOH treated liquid was then contacted with hydrogen in the presence of the same kind of Ni-Mo catalyst used with the run of Column 2 at the conditions reported in Table I, Column (4). The total nitrogen ($N_T$) of the KOH treated liquid was reduced by the hydrogen treatment from 1.39 wt.% to 0.04 wt.%. Also reduced was the oxygen content, from 0.61 wt.% to 0.18 wt.%, of the final product.

First order rate constants were calculated for overall hydrodenitrogenation and hydrodeoxygenation based on the previous runs. These constants are shown in Table II.

TABLE II

Hydrodenitrogenation Rate Constants are Improved by Oxygen Compound Removal

| | First Order Rate Constants ($k/hr^{-1}$) | |
|---|---|---|
| | Feed Containing Oxygen Compounds | Feed with Reduced Oxygen |
| Nitrogen ($N_T$) Removal | | |
| Temp. °C. | | |
| 375 | 0.335* | — |
| 400 | 0.859 (0.71) | 1.52 (1.77) |
| 425 | 1.46* | — |
| Oxygen Removal | | |
| Temp. °C. | | |
| 375 | 0.244* | — |
| 400 | 0.635 (0.71) | 0.505 (0.61) |

TABLE II-continued

| Hydrodenitrogenation Rate Constants are Improved by Oxygen Compound Removal | | |
|---|---|---|
| | First Order Rate Constants ($k/hr^{-1}$) | |
| | Feed Containing Oxygen Compounds | Feed with Reduced Oxygen |
| 425 | 1.26* | — |

*These runs are not reported herein in detail. Generally, the runs were performed in a similar manner as that reported for the run reported in Table I, Column 2.
( ) Enclosed values are based on initial and final analysis, whereas other values are based on samples taken during the run and at the end of the run.

As can be seen from Table II the rate constant for the nitrogen removal was substantially increased, almost by a factor of two, from 0.859 to 1.52. The significance of the rate constant is that in a new plant the size of the reactor can be smaller for a given capacity or that more throughput can be obtained in an existing unit. Another advantage is that the same throughput could be obtained at a lower temperature which results in lower operating costs because of reduced cracking, longer catalyst life and reduced coking of the catalyst.

The rate constant for the removal of the remaining oxygen compounds in the feed from which oxygen compounds were removed is almost the same as the untreated feed, 0.505 vs. 0.635.

The rate constants are based on the formula $C_t = C_o \cdot e^{-kt}$ wherein $C_t$=concentration at any given time, Co=initial concentration, e=base of natural logarithm, k=rate constant, and t=elapsed time.

Also, the increased effectiveness of the hydrogen used because of applicants' method can be seen from the results in the following Table III. The results are based on the data reported in Table I.

TABLE III

| Increased Effectiveness of Hydrogen Use | | |
|---|---|---|
| | Grams of Hydrogen Consumed per Gram of Feed | H/C Ratio of Product |
| Run 2 | .0218 | 1.47 |

TABLE III-continued

| Increased Effectiveness of Hydrogen Use | | |
|---|---|---|
| | Grams of Hydrogen Consumed per Gram of Feed | H/C Ratio of Product |
| Run 4 | .0178 | 1.51 |
| % of Run 4 to Run 2 | 81.5 | 103 |

The data shows that in Run 4 the hydrogen consumption was only 81.5% of that consumed in Run 2 and yet the H/C ratio of Run 4's product was some 3% greater.

In another comparative run a solvent refined coal liquid having a boiling range of about 350–850° F. was contacted with hydrogen in the presence of a Ni-Mo catalyst at the conditions reported in Table IV. As shown in Table IV the hydrogen treatment at both 375° C. and 400° C. resulted in an increase in the hydrogen content of the liquid with a decrease in the oxygen, nitrogen and sulfur content of the liquid (compare Columns 1 and 2).

In another embodiment of the invention the coal liquid with a boiling range of about 350–850° F. was solvent extracted using a mixture of dimethylformamide and heptanes to remove some of the oxygen compounds. As shown in Table IV the oxygen content was reduced to 0.31 wt.% from 3.86 wt.% while the $N_T$ was reduced to 0.38 wt.% from 1.19 wt.% (comparison of Columns 3 and 1). The treated feed having the composition shown in Column 3 was then treated with hydrogen and the same kind of Ni-Mo catalyst used with the runs represented by Column 2. As can be seen by a comparison of Columns 3 and 4 the nitrogen content of the feed (3) was reduced from 0.38 wt.% to 0.003 wt.% (@375° C.) or 0.001 wt.% (@400° C.). Also substantially reduced was the oxygen content of the feed (3) as well as the sulfur level (@400° C. Col. 2, vs. Col. 4).

First order rate constants were calculated for overall hydrodenitrogenation and hydrodeoxygenation based on the runs reported in Table IV. These constants are shown in Table V.

TABLE IV

| Method Shows Substantial Decrease In Nitrogen Content After Hydrogen Treatment | | | | | | |
|---|---|---|---|---|---|---|
| | Comparative[c] | | | Method of Invention[c] | | |
| | (1) Feed | (2) Hydrogen Treat of Feed | | (3) Feed After Removal of O[a] | (4) Hydrogen Treat of Feed | |
| Reaction Conditions | | | | | | |
| Time, Min. | — | 300 | 120 | — | 300 | 120 |
| Temp. °C. | — | 375 | 400 | — | 375 | 400 |
| Press. psig | — | 2500 | 2500 | — | 2500 | 2500 |
| Feed | | | | | | |
| SRC-II, gms | — | 356.5 | 289.3 | — | 286.5 | 288.5 |
| Catalyst[b] | | | | | | |
| Wt. gms. | — | 17.8 | 14.5 | — | 14.3 | 14.4 |
| Hydrogen Consumed | | | | | | |
| Wt. gms. | — | 6.81 | 4.94 | — | 4.18 | 4.21 |
| Wt. % | — | 1.91 | 1.71 | — | 1.46 | 1.46 |
| Product Analysis | | | | | | |
| Element, wt. % | | | | | | |
| C | 87.60 | 87.98 | 87.54 | 89.55 | 89.21 | 89.13 |
| H | 8.72 | 10.38 | 9.83 | 9.76 | 11.22 | 10.78 |
| O | 3.86 | 1.56 | 1.85 | 0.31 | 0 | 0.28 |
| $N_T$ | 1.19 | 0.444 | 0.483 | 0.38 | 0.003 | 0.001 |
| $N_B$ | 0.84 | 0.36 | — | 0.35 | 1.3 ppm | 3 ppm |
| S | 0.22 | — | 0.7 | 0.27 | 0 | 0.08 |

TABLE IV-continued

| | Method Shows Substantial Decrease In Nitrogen Content After Hydrogen Treatment | | | | | |
|---|---|---|---|---|---|---|
| | Comparative[c] | | | Method of Invention[c] | | |
| | (1) Feed | (2) Hydrogen Treat of Feed | | (3) Feed After Removal of O[a] | (4) Hydrogen Treat of Feed | |
| H/C Atomic Ratio | 1.19 | 1.41 | 1.34 | 1.31 | 1.51 | 1.45 |

[a]The coal liquid was run countercurrently through a column having 33 stages with the feed introduced at the 11th stage from the bottom. One volume of feed was used with a mixture of 2 volumes of N,N'—dimethylformamide and 12 volumes of heptanes. The extract amounted to about 27% of the feed, the analysis of the raffinate is as shown.
[b]Ni—Mo catalyst of composition shown in Table 1.
[c]Samples of the reaction mixture were taken during the runs and elemental analyses obtained. However only the results for the products are reported herein.

TABLE V

| Hydrodenitrogenation Rate Constants are Improved by Oxygen Compound Removal | | |
|---|---|---|
| | First Order Rate Constants ($k/hr^{-1}$) | |
| | Feed Containing Oxygen Compounds | Feed with Reduced Oxygen |
| Nitrogen Removal | | |
| Temp., °C. | | |
| 375 | 0.22 (.20) | 1.47 (0.97) |
| 400 | 0.53 (.45) | 3.3 (2.97) |
| Oxygen Removal | | |
| Temp., °C. | | |
| 375 | 0.16 (.18) | 0.12 |
| 400 | 0.44 (.37) | 0.59 |

( ) Enclosed values are based on initial and final analysis whereas other values are based on samples taken during the run and at the end of the run.

As can be seen from Table V the rate constant for nitrogen removal was substantially increased by reducing the oxygen content of the feed. However, the rate constant for the removal of the remaining oxygen remained about the same.

The extract, after separation of the extraction solvent, contained 2.46 wt.% $N_T$ and 8.11 wt.% O. After 60 minutes of hydrotreating at 375° C. and 2500 psig and in the presence of hydrogen and a sulfided NiMo catalyst a sample of the treated extract contained 1.878 wt.% $N_T$ and 6.73 wt.% O.

Other coal liquids, when treated in a similar manner for the removal of some of the oxygen, will benefit from an increase in rates of denitrogenation.

We claim:

1. In a catalytic hydrodenitrogenation treatment for conversion of nitrogen compounds contained in a coal liquid to hydrocarbons and ammonia, thereby to reduce the nitrogen level of the coal liquid prior to subsequent processing such as hydrocracking or catalytic cracking, the improvement which comprises, prior to the hydrodenitrogenation, removing oxygen and other compounds contained in the coal liquid, thereby to obtain a greater removal rate of the nitrogen compounds in the hydrodenitrogenation than that obtained in hydrodenitrogenation of the coal liquid without prior removal of said compounds, said removal comprising extracting the coal liquid with an extractant selected from aqueous methanol or a mixture of a dialkylformamide and a paraffinic hydrocarbon.

2. A process according to claim 1 wherein the extractant is a mixture of N,N'-dimethylformamide and heptanes.

3. A process according to claim 1 wherein the extractant for the coal liquid is aqueous methanol.

4. A process according to claim 1 wherein the extractant for the coal liquid is a mixture of a dialkylformamide and a paraffinic hydrocarbon.

5. Process according to claims 1, 3 or 4 wherein the hydrogenation catalyst is selected from the group consisting of nickel-molybdenum on alumina, cobalt-molybdenum on alumina, and nickel tungsten on alumina, the hydrogenation temperature is in the range of between from about 300° C. to about 450° C., the partial pressure of the hydrogen is in the range of between from about 200 psig to about 5000 psig, and the amount of nitrogen removed is sufficient so that resulting product can be used as feed to a hydrocracker or a catalytic cracking unit.

6. Process according to claims 1, 3 or 4 wherein the coal liquid results from a hydroliquifaction coal process.

* * * * *